US007641503B1

(12) United States Patent
van der Horn et al.

(10) Patent No.: US 7,641,503 B1
(45) Date of Patent: Jan. 5, 2010

(54) CABLE STRAIN RELIEVER

(75) Inventors: Robert van der Horn, Groningen (NL); Rudy Stubenitsky, Emmen (NL)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 12/334,673

(22) Filed: Dec. 15, 2008

(51) Int. Cl.
*H01R 4/66* (2006.01)

(52) U.S. Cl. ..... 439/457; 439/459; 439/584

(58) Field of Classification Search ..... 439/457, 439/459, 584, 456

See application file for complete search history.

(56) References Cited

U.S. PATENT DOCUMENTS

| | | | | |
|---|---|---|---|---|
| 2,759,162 | A * | 8/1956 | Simkins | 439/456 |
| 3,397,379 | A * | 8/1968 | Puig | 439/414 |
| 4,199,207 | A * | 4/1980 | Lee | 439/102 |
| 4,846,706 | A * | 7/1989 | Lee | 439/104 |
| 6,113,420 | A * | 9/2000 | Harting et al. | 439/459 |
| 6,648,674 | B1 * | 11/2003 | Dobler | 439/460 |

FOREIGN PATENT DOCUMENTS

| | | |
|---|---|---|
| EP | 1 017 137 A2 | 7/2000 |
| EP | 1 655 809 A1 | 5/2006 |

OTHER PUBLICATIONS

International Search Report and Written Opinion for corresponding Application No. PCT/EP2009/056298 dated Aug. 19, 2009.

* cited by examiner

*Primary Examiner*—Gary F. Paumen
(74) *Attorney, Agent, or Firm*—Renner, Otto, Boisselle & Sklar, LLP

(57) ABSTRACT

A combined cable strain reliever and cable rotation restrainer is disclosed. The combined cable strain reliever and cable rotation restrainer comprises a first part, a second part and a cable. The first part is adapted to be connected to the cable and to the second part, wherein the first part and the second part are arranged to interact for absorbing/taking up forces exerted on the cable connected to the first part. The cable strain reliever and cable rotation restrainer is adapted to be used with a portable electronic device. The cable strain reliever and cable rotation restrainer prevents the cable from being damaged and rotated inside the second part when being assembled therein.

17 Claims, 7 Drawing Sheets

CABLE STRAIN RELIEVER

TECHNICAL FIELD OF THE INVENTION

The present invention relates to a cable strain reliever. The cable strain reliever may advantageously be used when connecting cables at electrical connections/terminals in or for portable electronic devices.

DESCRIPTION OF RELATED ART

Nowadays, one example of strain relief for cables for preventing damages thereto when connected to electric connections is a cable knot, i.e. the cable is tied together as a knot and pulled into a tube or connector end when assembled. This cable strain relief is used for example in electrical connections of different kinds, e.g. in portable electronic devices, such as mobile telephones, laptops, smart phones, communicators, cameras, digital audio players (e.g. MP3-players or iPods®), stationary or portable loudspeakers, stationary computers, or other electronic devices, e.g. picture or movie projectors, such as television receivers, monitors or electronic picture frames, and portable accessory items, such as headsets, earphones, portable loudspeakers or the like.

This known solution may be used in electrical connections combined with a threaded mechanical construction, where the knot including the cable is assembled with a threaded tube.

SUMMARY OF THE INVENTION

It has therefore, with the above and following description in mind, then, been an aspect of the present invention to provide an improved device, which seeks to mitigate, alleviate or eliminate one or more of the above-identified deficiencies in the art and disadvantages singly or in any combination.

The present invention is defined by the appended independent claims. Various advantageous embodiments of the invention are set forth by the appended dependent claims as well as by the following description and the accompanying drawings.

An aspect relates to a cable strain reliever for connection to at least one electronic device. The cable strain reliever comprises at least one cable, at least a first part, and at least a second part, the first part being adapted to be connected to the cable and to the second part, wherein the first part and the second part are arranged to interact for absorbing/taking up forces exerted on the cable connected to the first part.

Another aspect relates to the cable strain reliever, wherein the first part comprises at least three recesses for receiving the cable.

Yet another aspect relates to the cable strain reliever, wherein the second part comprises a through hole in which the first part is arranged.

Still another aspect relates to the cable connector, wherein the inner diameter of the through hole in the second part and the outer diameter of the first part are designed to achieve/accomplish a tight fit between the two parts and the cable.

In another aspect, in the cable strain reliever the tight fit is created by squeezing the cable between the first part and the second part when the first part and the cable are mounted in the second part for achieving a cable strain relieving force.

In yet another aspect of the cable strain reliever, the first part comprises a portion for hindering rotation of the first part inside the second part.

In still another aspect of the cable strain reliever, the rotation hindering portion is adapted to be connected to a third fixed part forming a stationary anvil.

Another aspect relates to the cable connector, wherein the cable strain reliever is intended for the usage together with a portable electronic device.

Yet another aspect relates to the cable strain reliever, wherein the cable strain reliever is intended for the usage together with the portable electronic device, wherein the portable electronic device is a device from a group comprising: a mobile radio terminal, a mobile telephone, a cellular telephone, a pager, a communicator, a smart phone, a Personal Digital Assistant (PDA), an electronic organizer, a computer, an audio player, an electronic picture frame or a digital camera.

Still another aspect relates to the cable strain reliever, wherein the first part comprises at least three separate recesses in the form of channels, whereby each channel forms only one cable run for the cable.

Another aspect relates to the cable strain reliever, wherein the second part has a varying inner dimension for creating a tight fit between the cable and the parts for squeezing the cable when mounted.

Yet another aspect relates to the cable strain reliever, wherein the second part has a conical inner shape.

Still another aspect relates to the cable strain reliever, wherein at least one channel is enclosed.

In another aspect relating to the cable strain reliever, at least one channel is partly open lengthwise, while, in yet another aspect relating to the cable strain reliever, at least one channel is enclosed and at least one channel is partly open lengthwise.

In some aspects of the present invention a strain relief for cables is provided in the form of a cable strain reliever that may serve a dual purpose. In one aspect of the invention, the cable strain reliever prevents cables from getting damaged by too high axial forces when the cable is pulled for assembly into terminals in electric connections. In another aspect of the invention, the cable strain reliever enables the cable to be fixedly held against rotary motion, i.e. the cable is not rotated during assembly.

In yet another aspect of the invention, the cable strain reliever prevents a cable from getting damaged by too high axial forces when the cable is pulled during assembly into terminals for electric connection, while, at the same time, enables the cable to be fixedly held against rotary motion meaning that the cable is not rotated during assembly. According to one aspect, the strain relief is solved by adding a special designed part in combination with a tube and a cable meander creating essential friction helping the strain relieve principal in the pulling direction of the cable. According to another aspect, the rotation of the cable during assembly is prevented by adding an anti-rotation feature.

Thus, as explained, the cable strain reliever according to some aspects of the invention can serve as a strain reliever for axial forces in the cable or a strain reliever for rotational forces in the cable or it can serve as a smart two-in-one device having both functions, i.e. cable strain relieving preventing against both axially induced cable damages and rotary induced cable damages during assembly and usage. Hence, the invention enables reliable and simple cable assembly and usage.

It is an advantage with some aspects of the invention that only one cable strain reliever is necessary for serving two different purposes, i.e. both axial strain relief and anti-rotation, as there is a reduced risk of cable damages. Furthermore, the risk for damaging various items, such as electrical terminals and connections, may be limited, since cables do not get damaged and/or transmit large pulling or rotary forces to the connections to which the cable is coupled. This solution eliminates problems when used in electrical connections in combination with a treaded mechanical construction, as the knot including the cable is prevented from rotating when assembling the threaded tube. In other aspects, the cable strain reliever is easy to rework during assembly in the factory for reducing the scrap cost.

Furthermore, the invention reduces costs, prevents the user from destroying the cables by using too much force when trying to disassemble or assemble the electrical connection, whereby new cables and electrical connectors may have to be bought. The invention may also prevent a worst case scenario from occurring, i.e. if the cable is pulled too violently and connected to an electronic terminal or device, the electronic connection or terminal or device, especially the socket into which the cable is plugged into, is prevented from breaking or at least prevented from being damaged, such that loose or bad contact or even no contact between the socket and the cable end is hindered. The invention reduces the risk of having the electronic connection or cable repaired or even replaced, whereby at least practical problems and increased costs are less prone to occur.

BRIEF DESCRIPTION OF THE DRAWINGS

Further objects, features and advantages of the invention will appear from the following detailed description of embodiments of the invention, wherein embodiments of the invention will be described in more detail with reference to the accompanying drawings, in which.

DETAILED DESCRIPTION OF EMBODIMENTS

An aspect of the present invention will be described more fully hereinafter with reference to the accompanying drawings. FIGS. 1-7 show a cable strain reliever 10 according to embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. All features and embodiments may also be applied singly or in any combination for achieving the invention, i.e. the cable strain reliever 10.

Figure 7:
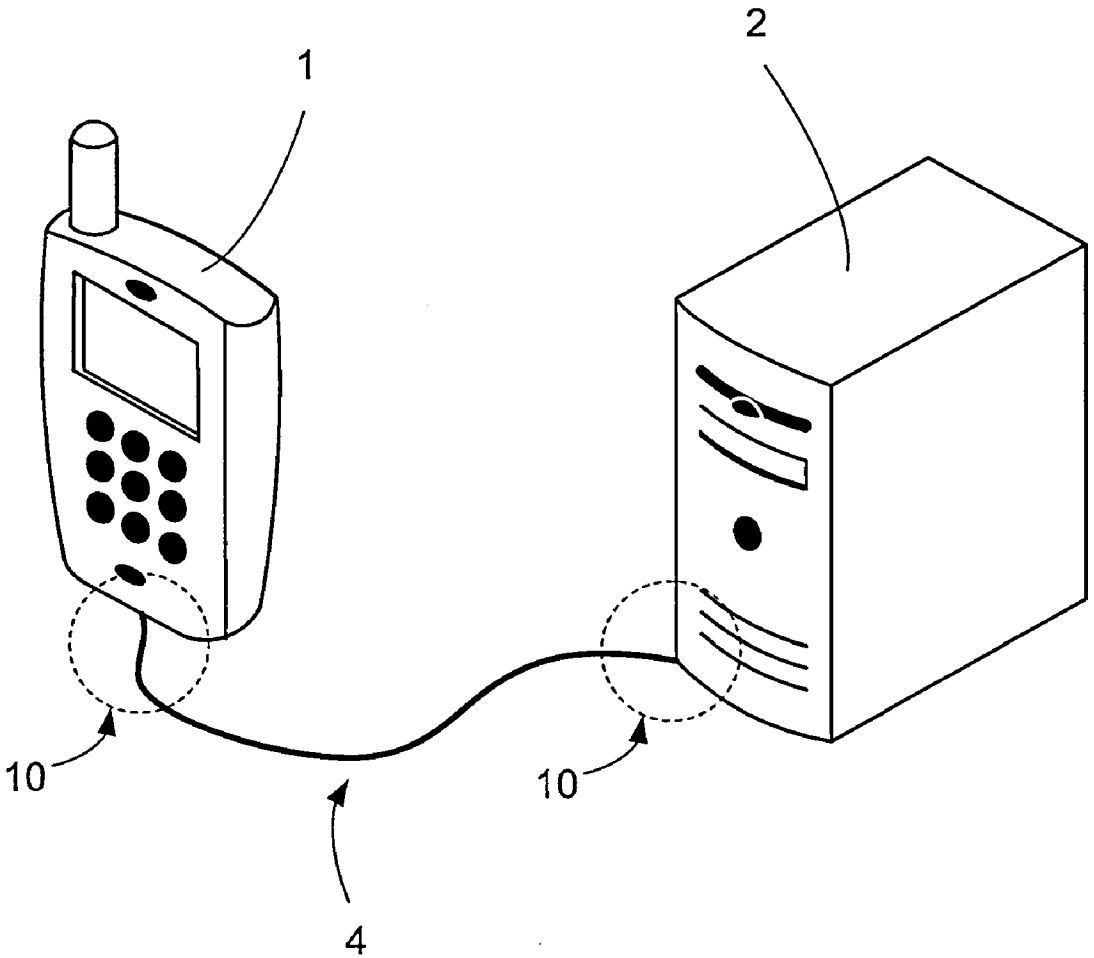
FIG. 7 shows schematically the cable strain reliever in FIGS. 1 to 6 when used in a portable electronic device or a stationary computer, respectively, as exemplary usage of the cable strain reliever according to the invention.

The cable strain reliever 10 according to the disclosed embodiments is preferably, but not necessarily, intended for the usage together with a portable electronic device 1 or a stationary electronic device 2 (see FIG. 7). The portable or the stationary electronic device may be any electronic device such as, e.g. a mobile radio terminal, a mobile telephone, a cellular telephone, a pager, a communicator, a smart phone, a Personal Digital Assistant (PDA), an electronic organizer, a portable or stationary computer 2, a digital audio player such as a MP3-player or an iPod®, a digital camera, an electronic picture frame, a television receiver, a Home cinema, or any other suitable picture or movie projector.

The cable strain reliever 10 is assembled into an electrical connection 3 of the electronic device 1, 2 with a cable 4 by means of a threaded connection 5. The cable strain reliever 10 comprises a first part, i.e. a single elongated strain reliever body 20 in the form of at least a partly hollow cylindrical body being adapted to be at least partly enclosed by a second part, i.e. a tube-shaped and threaded body 30 that is thread onto the threaded connection 5 as a third part when assembled.

Figure 1:
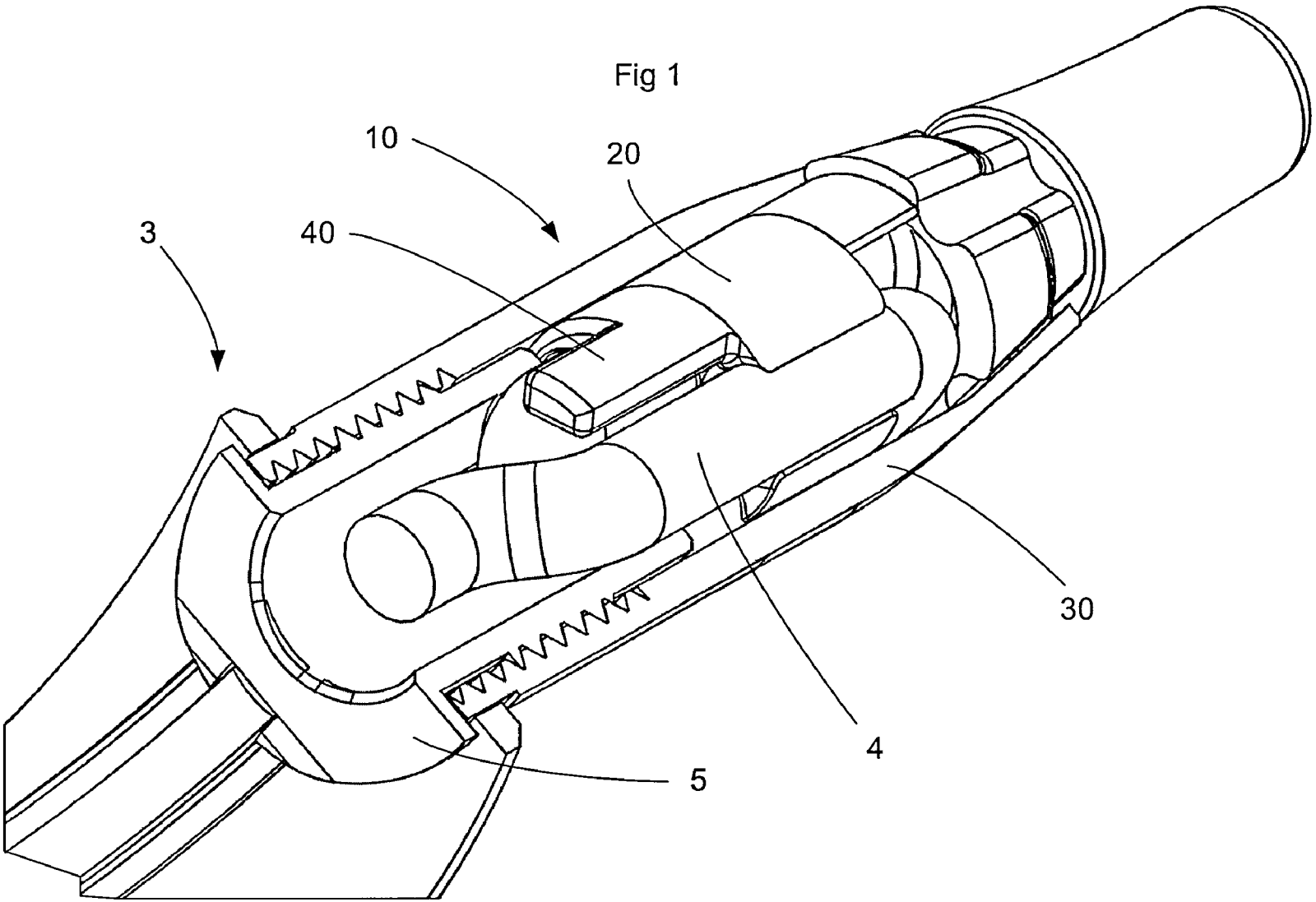
FIG. 1 shows a view of a cable strain reliever according to an embodiment of the invention when the cable strain reliever is assembled with a cable.
Figure 2:
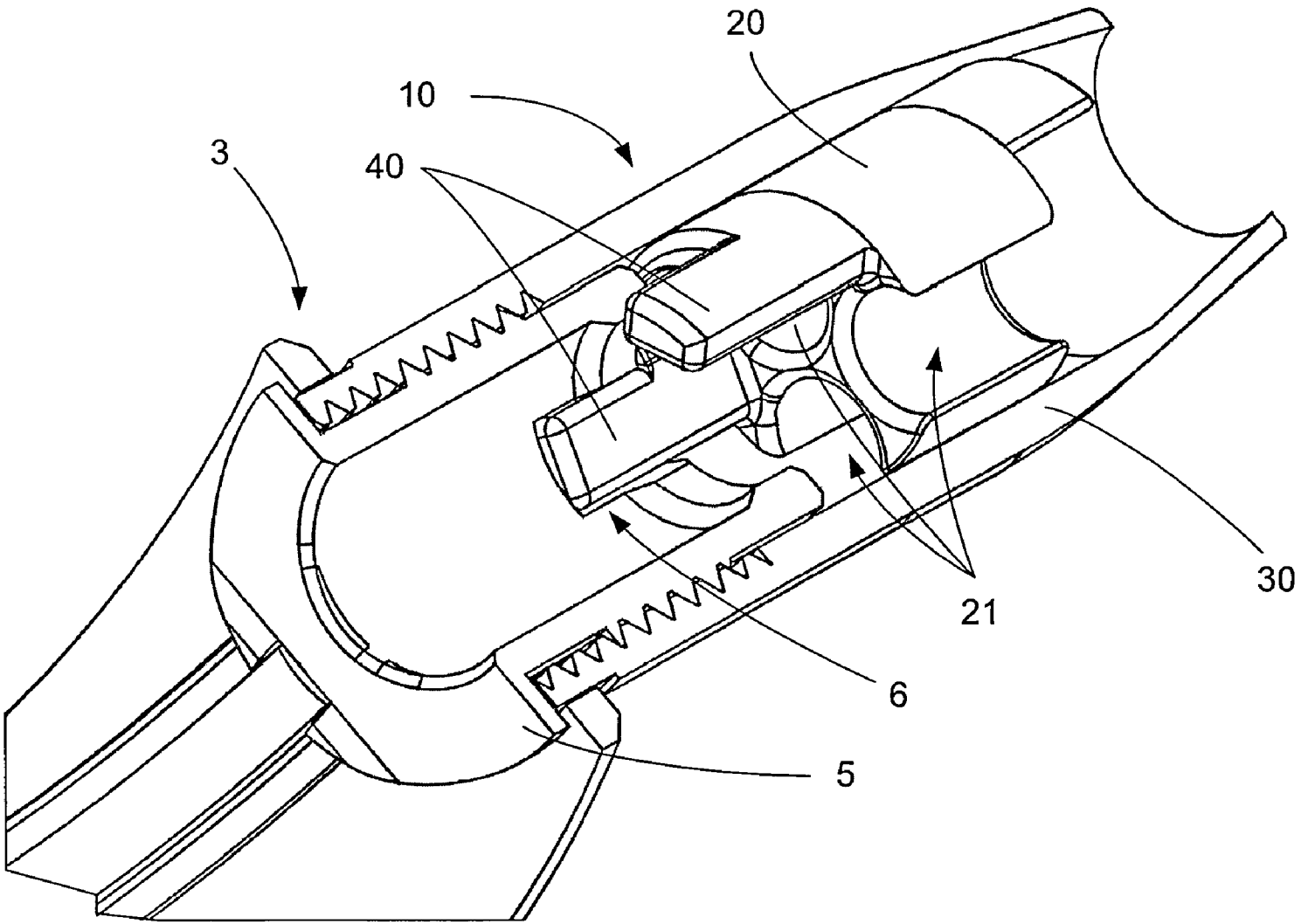
FIG. 2 shows a view of the cable connector in FIG. 1 when the cable strain reliever is assembled without the cable.
Figure 3:
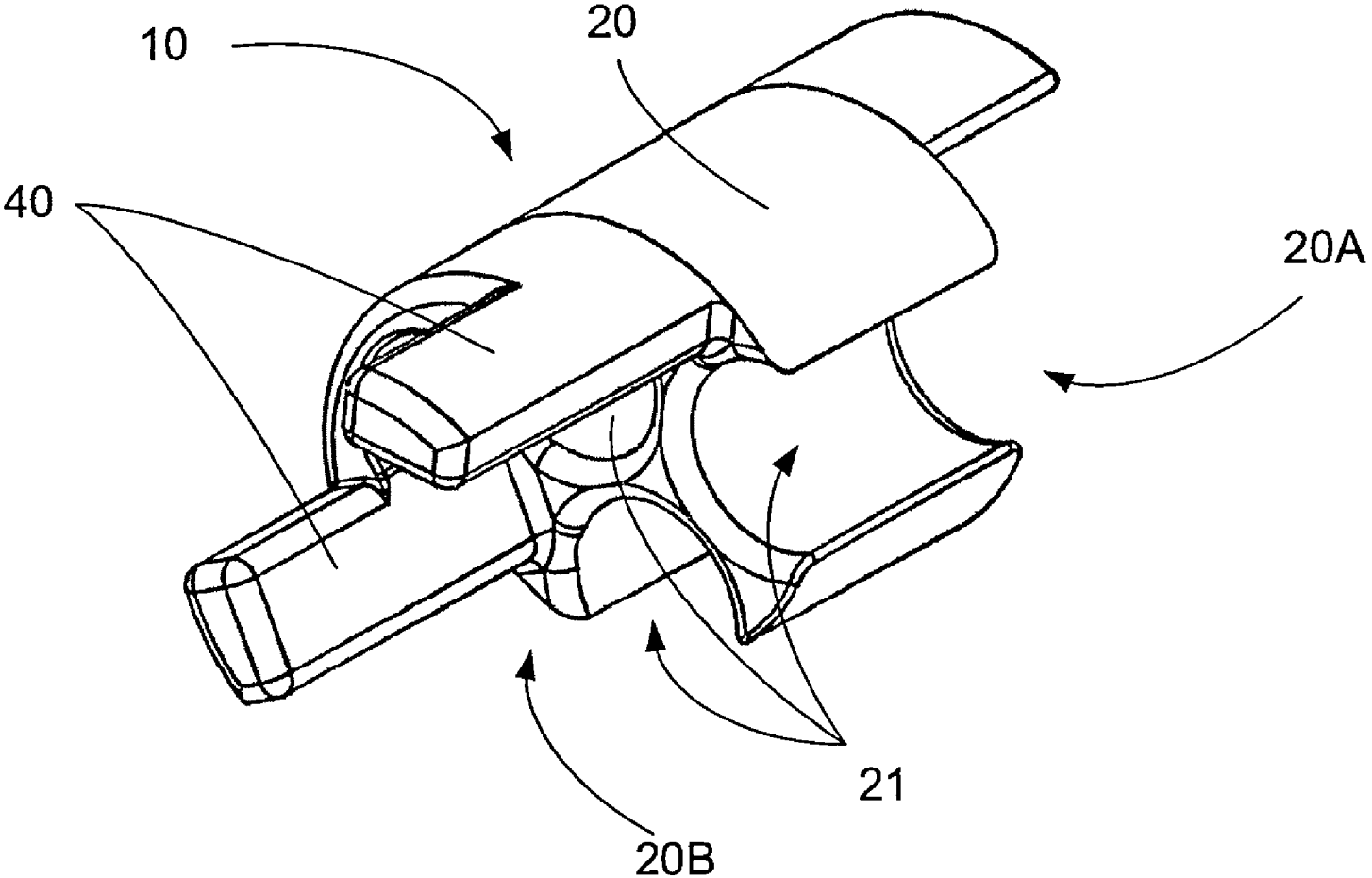
FIG. 3 shows a view of the cable strain reliever in FIGS. 1 and 2 when the cable strain reliever is disassembled without the cable.
Figure 4:
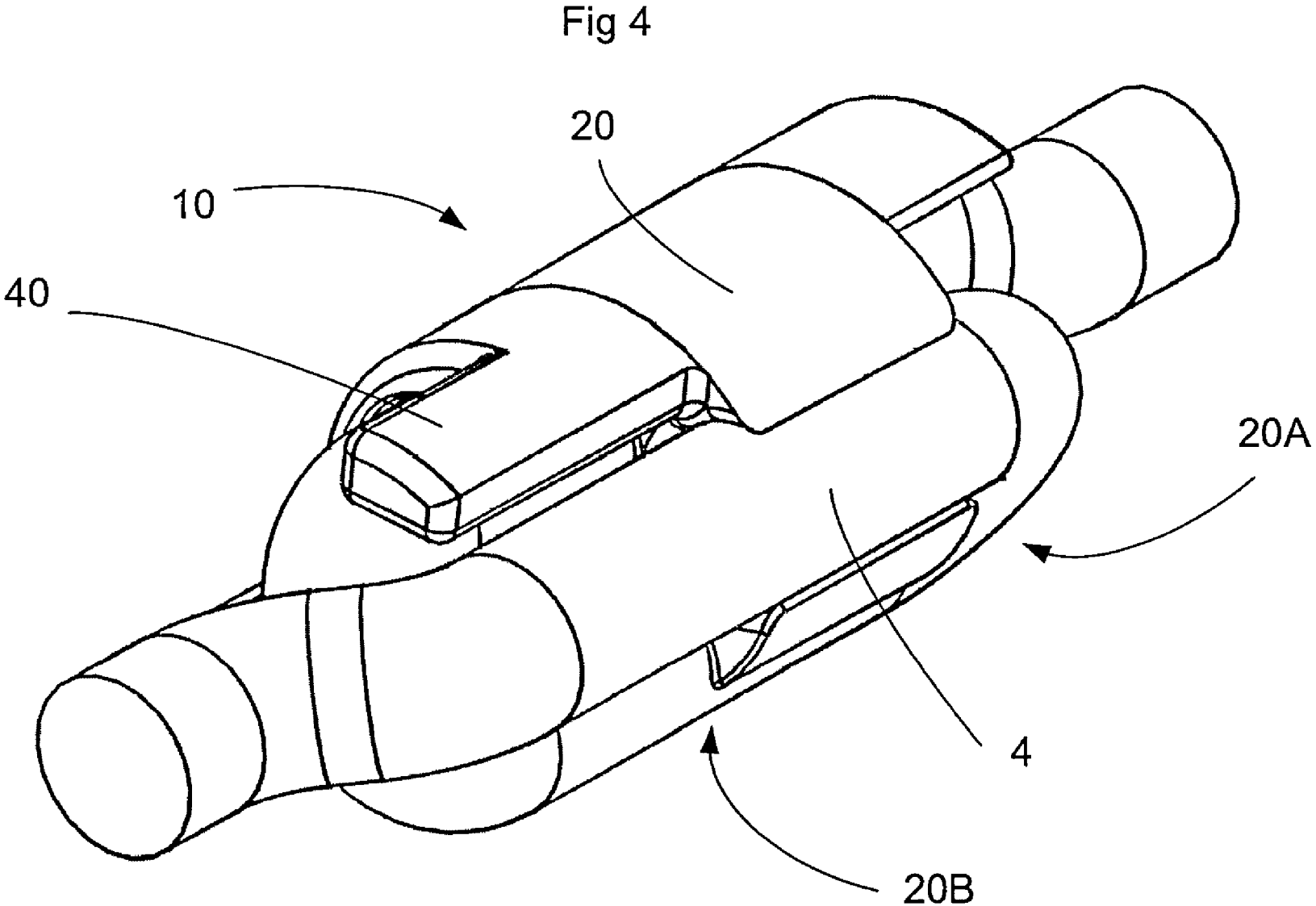
FIG. 4 shows a view of the cable strain reliever in FIG. 3 when the cable strain reliever is disassembled with the cable.
Figure 5:
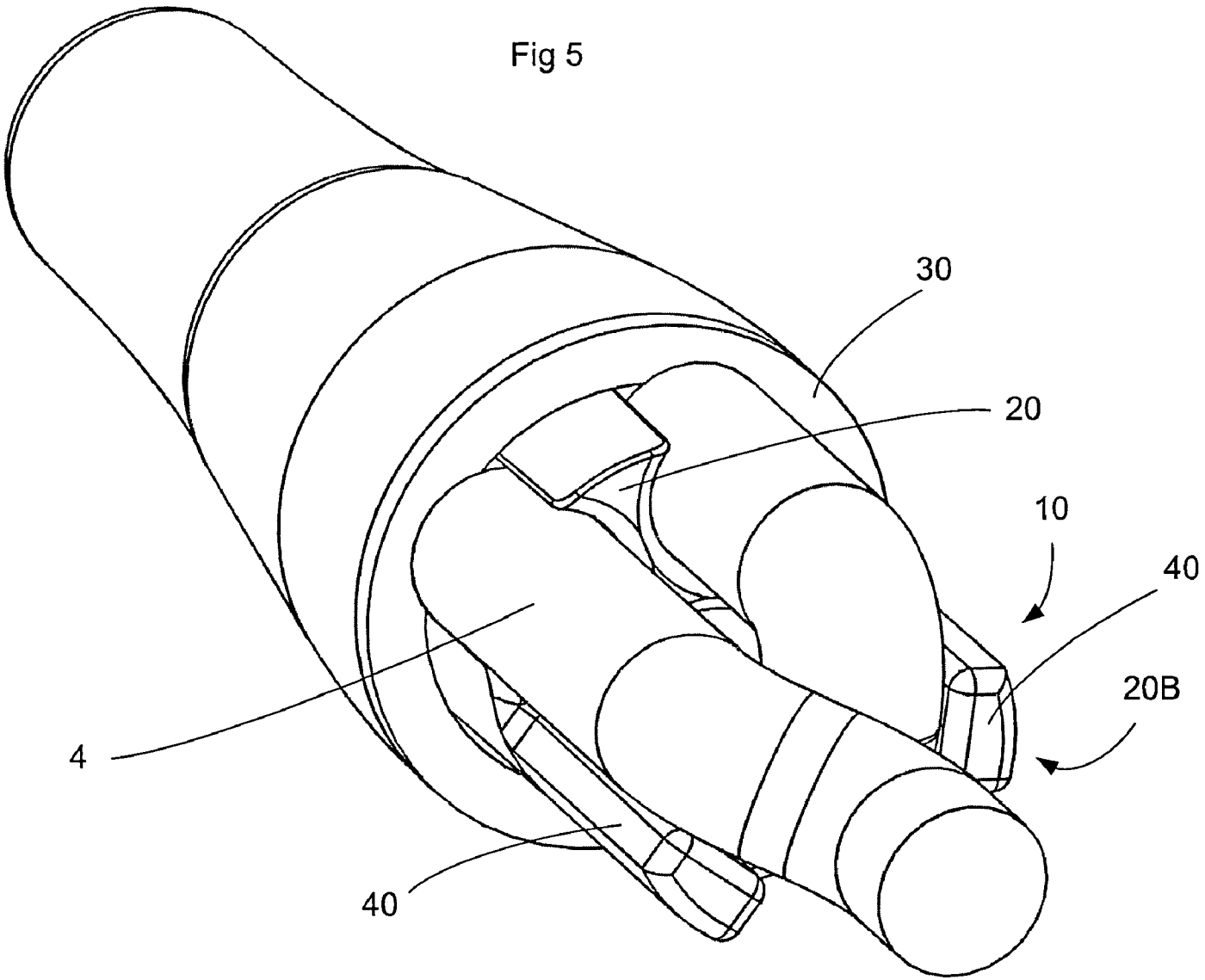
FIG. 5 shows a partly cut-out view of the cable strain reliever in FIGS. 1 to 4 when the cable strain reliever is partly assembled with the cable within a tube end.

As can be seen in FIG. 3, the cable strain reliever body 20 is provided with at least three openings at each end, a first end 20A and a second end 20B, and at least three through holes 21 opening at each associated end opening. Two of the through holes 21 are not enclosed or surrounded cavities, i.e. these cavities are partly open recesses for simplifying the assembly of the cable 4 therein but one or both of these cavities could of course be enclosed in other embodiments. This means that these cavities only surround a part of the envelope surface of the cable but could in other embodiments enclose the whole envelope surface of the associated cable length fitted therein. The cable runs three times through the whole length of the cable strain reliever body 20, i.e. one cable length runs through each hole 21, forming two windings of the cable. In some embodiments, more than three cable windings are possible, but require more space, i.e. a larger reliever body and tube 30. The increase in size depends of course on the size of the cable and how many cable windings that are used.

The cable strain reliever 10 is formed by three primary components, i.e. the cable strain reliever body 20, the cable 4 winded through this body and the threaded tube 30. The cable strain reliever is assembled after tying the cable knot by means of the reliever body and then pulling the body and the cable knot into the threaded tube and then threading the tube onto the threaded connection 5. The tube 30 has a varying diameter or size such that the cable 4 is compressed more and more, i.e. squeezed more and more between the body 20 and the tube, the further the body is pulled into the tube or the further the tube is threaded.

The threaded connection 5 works as an anvil with one end abutting against the reliever body 20 such that it is fixed lengthwise and do not rotate while the threaded tube 30 is rotated and moves axially along the cable 4 and the reliever body during assembly by threading it onto the connection 5. This means that the threading of the tube and its decreasing inner dimension in the opposite direction of the threading compresses the cable in the reliever body 20 more and more as the tube 30 moves while rotating it along the threaded connection towards the other end of the connection 5 until the tube "bottoms", i.e. when threaded as far as possible. The tube 30 is preferably conically shaped for achieving the varying diameter, and made in a sufficiently stiff material, and may, in other embodiments, be manufactured without a varying inner dimension but in a flexible material that still enables the cable 4 to be squeezed between the reliever body 20 and the tube such that the cable is sufficiently compressed. The compression of the cable 4 means that the cable is squeezed creating a sufficient friction between the reliever body, the tube 30, and the cable for relieving the cable knot from damaging strain if subjected to large pulling forces. This friction may also be controlled by choosing materials in the body, the tube and the cable that optimize the friction there between. The design with one wholly enclosing through hole 21 and two partly open recesses 21 means that the cable in the relatively stiff reliever body 20 is easier to compress compared to an embodiment where all the through holes 21 where enclosed. In the latter embodiment with fully enclosing holes, the reliever body could "crease" when compressed such that material could be abundant hindering or at least render further compression more difficult.

The cable strain reliever body 20 may comprise at least one, preferably two protrusions 40 extending from at least one end 20A or 20B, in this embodiment end 20B. In another embodiment, the cable strain reliever body could be equipped with at least one protrusion at each end 20A, 20B. These protrusions 40 are designed as integrated and fixed parts of the strain reliever body and adapted to be fitted into receiving recesses or holes 6 in the threaded connection 5 when the threaded tube 30 is threaded thereon. The protrusions 40 together with the recesses 6 form a grip by their shapes fitting into each other, but could, in other embodiments, be held together by force, e.g. a tight fit, adhesion or similar suitable attachments. The recesses 6 are arranged on the end of the connection 5 that has the anvil function explained above. In another embodiment, the arrangement of recesses and protrusions may be inverted, i.e. the recesses 6 could instead be arranged on the reliever body 20 and the protrusions 40 be placed on the connection 5.

The cable strain reliever body 20 and the cable 4 in the embodiment shown in the figures are connected by introducing a first end of the cable through one opening 21 at the first end 20A or the second end 20B of the body, e.g. through the through hole, i.e. the cavity enclosing the whole envelope surface of the cable when the cable is fitted therein, a first time, and leading it through the whole cable strain reliever body length and out of the second opening at the second cable strain reliever body end 20A or 20B. Then, the cable end passed through the cable strain reliever body is winded and inserted into the reliever body a second time by pressing it into one of the other two recesses, which are partly open lengthwise exposing at least a part of the cable envelope surface, in a third opening 21 at this second end 20A or 20B, along the whole cable strain reliever body length again through this second recess and out of a fourth opening, and then the cable is winded a second time by pressing another cable length portion into the third recess, i.e. into a fifth opening in the second partly open recess 21, and guiding the cable back through this third recess to the first body end 20A or the second body end 20B along the whole cable strain reliever body length a third time and out of a sixth opening at the second cable strain reliever body end 20A or 20B once again. This embodiment exposes at least two cable lengths such that at least a part of each of their envelope surfaces is in contact with the inner surface of the tube 30 during and after assembly in the tube for creating the necessary friction between the reliever body 20 and the cable 4, and the cable and the inside of the tube 30. In the embodiment with the single enclosing through hole 21, this through hole creates a reaction force that stops the forces applied onto the cable 4 by using the friction between the squeezed cable and the reliever body and the tube.

Figure 6:
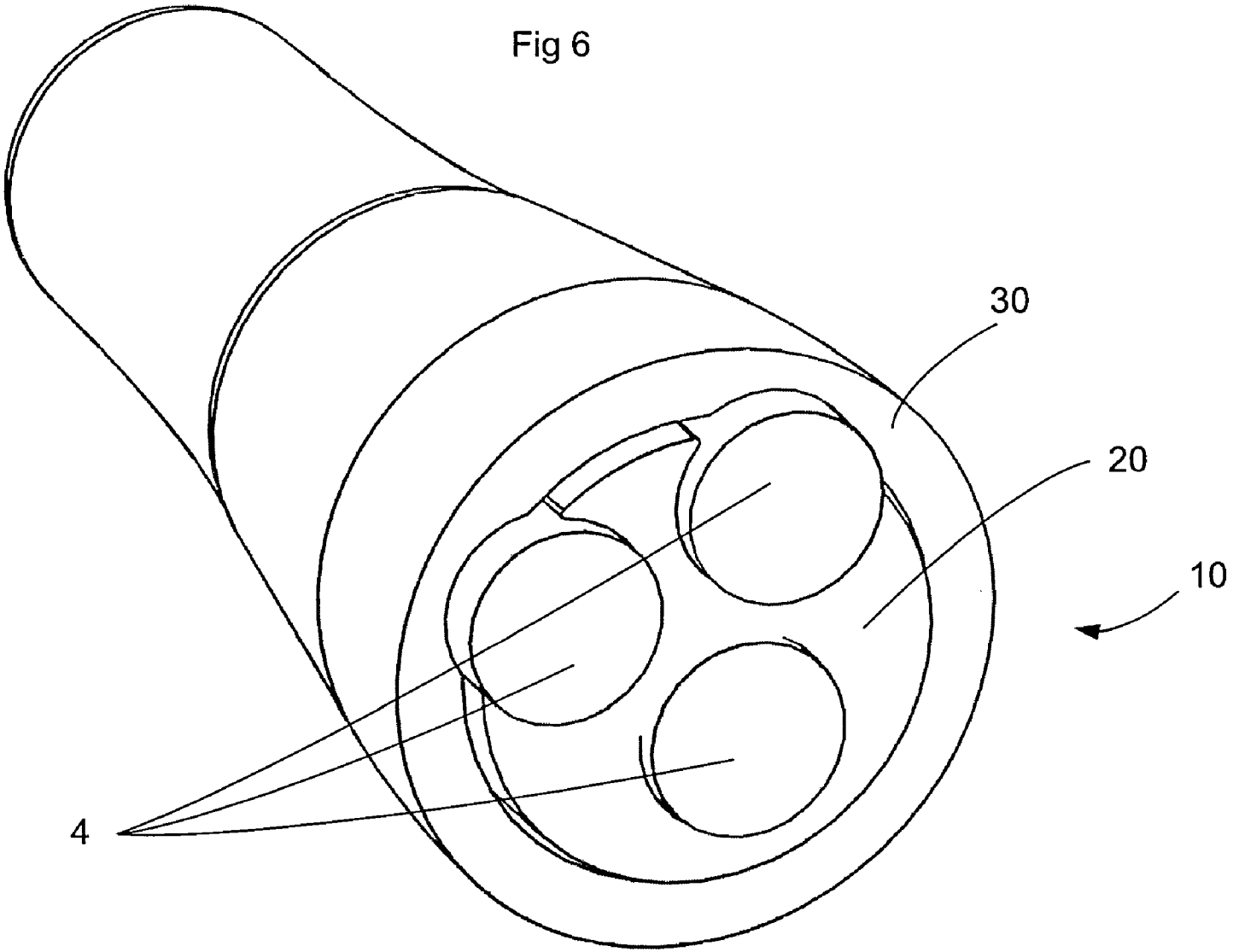
FIG. 6 shows a cross-section of the cable strain reliever in FIG. 5 when the cable strain reliever is partly assembled with the cable cross-sections visible at the tube end.

In some embodiments of the cable strain reliever 10 the body 20 may comprise more than three through holes or recesses 21. The cable strain reliever body comprises at least three separate channels or lead-throughs from one end 20A to the other end 20B, whereby each channel forms one cable run for the cable 4. This means that no more than one cable length runs through each channel forming a single-circuit line and that the cross-section of the body 20 may be triple-barrelled as shown in FIG. 6 or quad-barrelled or more. The lengthwise separation of the cable length channels may be performed by moulding the reliever body of sufficiently stiff plastic or rubber, e.g. PC, ABS, glass filled plastic or other suitable material. In another embodiment with a solid reliever body 20, drilling or milling or any other suitable method of creating through holes in the reliever body and the tube 30 may be used. The reliever body and/or tube may also be made of a suitable metal, e.g. aluminum, whereby casting or continuous casting or extrusion may be used for creating the through holes 21 and the body/tube itself.

The compression of the cable 4 is created by adapting the dimensions of the tube 30, the cable and the reliever body 20 in relation to each other. The adaptation and optimization of their relative sizes create a tight fit and predictable cable holding forces for enabling the strain relieving of the cable when these three components are assembled together. The dimensions and the features, i.e. the stiffness and flexibility of the three primary components, i.e. the stiff tube 30, the stiff reliever body 20 and the sufficiently flexible cable 4, are adapted in relation to each other for creating a sufficient cable holding friction with a predictable magnitude/size when the cable strain reliever is assembled together with the cable. The choice of material in the tube, the reliever body and/or the cable should be predictable in regard of dimension and change in dimension when subject to compression for the reliever body and the cable and extension for the tube being pressed from the inside by the cable.

Hence, the invention relates to a cable strain reliever that, in some embodiments, may be a combined cable strain reliever and cable rotation restrainer.

The present invention has been described above with reference to specific embodiments. Many modifications can be made by a person skilled in the art. The embodiments described above are merely illustrative examples and the invention can be modified and used together with many different products, not only portable electronic devices as indicated in the detailed description. The different features of the invention can be combined in other combinations than those described. The invention is only limited by the appended claims.

What is claimed is:

1. A cable strain reliever for connection to at least one electronic device, comprising at least one cable, at least a first part, and at least a second part, the first part being adapted to be connected to the cable and to the second part, wherein the first part and the second part are arranged to interact for taking up forces exerted on the cable connected to the first part, wherein the first part comprises at least three recesses for receiving the cable, whereby each recess forms one cable run for the cable, and the second part comprises a through hole in which the first part is arranged, wherein the inner diameter of the through hole in the second part and the outer diameter of the first part are designed to achieve a tight fit between the two parts and the cable and the tight fit is created by squeezing the cable between the first part and the second Part when the first part and the cable are mounted in the second part for achieving a cable strain relieving force.

2. The cable strain reliever as recited in claim 1, wherein the first part comprises a portion for hindering rotation of the first part inside the second part.

3. The cable strain reliever as recited in claim 2, wherein the rotation hindering portion is adapted to be connected to a third fixed part forming a stationary anvil.

4. The cable strain reliever as recited in claim 2, wherein the cable strain reliever is intended for the usage together with a portable electronic device.

5. The cable strain reliever as recited in claim 4, wherein the cable strain reliever is intended for the usage together with the portable electronic device, wherein the portable electronic device is a device from a group comprising: a mobile radio terminal, a mobile telephone, a cellular telephone, a pager, a communicator, a smart phone, a Personal Digital Assistant (PDA), an electronic organizer, a computer, an audio player, an electronic picture frame or a digital camera.

6. The cable strain reliever as recited in claim 1, wherein the first part comprises at least three separate recesses in the form of channels, whereby each channel forms only one cable run for the cable.

7. The cable strain reliever as recited in claim 1, wherein the second part has a varying inner dimension for creating a tight fit between the cable and the parts for squeezing the cable when mounted.

8. The cable strain reliever as recited in claim 7, wherein the second part has a conical inner shape.

9. The cable strain reliever as recited in claim 6, wherein at least one channel is enclosed.

10. The cable strain reliever as recited in claim 6, wherein at least one channel is partly open lengthwise.

11. The cable strain reliever as recited in claim 6, wherein at least one channel is enclosed and at least one channel is partly open lengthwise.

12. The cable strain reliever as recited in claim 3, wherein the cable strain reliever is intended for the usage together with a portable electronic device.

13. The cable strain reliever as recited in claim 12, wherein the cable strain reliever is intended for the usage together with the portable electronic device, wherein the portable electronic device is a device from a group comprising: a mobile radio terminal, a mobile telephone, a cellular telephone, a pager, a communicator, a smart phone, a Personal Digital Assistant (PDA), an electronic organizer, a computer, an audio player, an electronic picture frame or a digital camera.

14. The cable strain reliever as recited in claim 2, wherein the second part has a varying inner dimension for creating a tight fit between the cable and the parts for squeezing the cable when mounted.

15. The cable strain reliever as recited in claim 3, wherein the second part has a varying inner dimension for creating a tight fit between the cable and the parts for squeezing the cable when mounted.

16. The cable strain reliever as recited in claim 14, wherein the second part has a conical inner shape.

17. The cable strain reliever as recited in claim 15, wherein the second part has a conical inner shape.

* * * * *